United States Patent [19]

Ikeda et al.

[11] Patent Number: 4,551,258

[45] Date of Patent: Nov. 5, 1985

[54] GREASE COMPOSITION

[75] Inventors: Makoto Ikeda; Akira Nakamura, both of Ichihara, Japan

[73] Assignee: Idemitsu Kosan Company Limited, Tokyo, Japan

[21] Appl. No.: 642,498

[22] Filed: Aug. 20, 1984

[30] Foreign Application Priority Data

Aug. 26, 1983 [JP] Japan ..... 58-154924

[51] Int. Cl.[4] ..... C10M 5/24; C10M 5/28

[52] U.S. Cl. ..... 252/32.7 E; 252/33.6; 252/46.4; 252/49.7

[58] Field of Search ..... 252/32.7 E, 33.6, 49.7, 252/46.4

[56] References Cited

FOREIGN PATENT DOCUMENTS 53-7441 1/1978 Japan .

55-165997 12/1980 Japan .

57-3894 1/1982 Japan .

OTHER PUBLICATIONS

Smalheer et al., "Lubricant Additives" 1967, pp. 6 and 10.

*Primary Examiner*—Jacqueline V. Howard

*Attorney, Agent, or Firm*—Frishauf, Holtz, Goodman & Woodward

[57] ABSTRACT

A grease composition comprising: (a) from 1 to 4 parts by weight of a zinc dithiophosphate; (b) from 2 to 6 parts by weight of a phosphoric acid ester; and (c) from 0.5 to 2 parts by weight of an organotin compound admixed in 100 parts by weight of a base grease. This grease has excellent lubricating characteristics and is even suitable for use in delicate bearings such as needle bearings.

17 Claims, No Drawings

GREASE COMPOSITION

BACKGROUND OF THE INVENTION

The present invention relates to a highly lubricant grease composition free from the problem of forming a black denaturated matter during use.

Needless to say, lubricants such as greases are widely used in a great variety of machines having rotating or sliding parts including industrial machines, automobiles, railway cars and the like with an object to reduce the friction and decrease wear of the parts. It is sometimes undertaken to admix a grease with a solid lubricant such as molybdenum sulfide with an object to improve the lubricant performance of the grease.

There is a problem, however, in the admixture of a grease with a solid lubricant such as molybdenum sulfide that, when such a grease is used in a machine part having a needle bearing in the structure such as a tri-port-type constant velocity joint, the solid component sometimes enter the needles. Therefore, such a grease with admixture of a solid ingredient is not always acceptable.

As an alternative way to improve the lubricant performance of a grease without using such a solid ingredient, the present inventors prepared a grease with a zinc dithiophosphate. This grease was tested. It was found that black denaturated matter is formed in the grease during use which enters the needles of a needle bearing so that regular rotation on the bearing is sometimes disturbed.

SUMMARY OF THE INVENTION

An object of the present invention is therefore to provide an improved grease composition having excellent lubricant performance free from the above described problems and disadvantages in the grease compositions admixed with a solid ingredient or zinc dithiophosphate. This object can well be achieved by the present invention completed on the base of the discovery as a result of the extensive investigations by the inventors that a grease composition admixed with the undermentioned three additives in a specific proportion is advantageously excellent in lubricant performance but still from the problems accompanying the admixture of a solid ingredient or zinc dithiophosphate alone.

Thus, the grease composition of the invention comprises:

(a) from 1 to 4 parts by weight of a zinc dithiophosphate;

(b) from 2 to 6 parts by weight of a phosphoric acid ester;

and (c) from 0.5 to 2 parts by weight of an organotin compound admixed in 100 parts by weight of a base grease.

DETAILED DESCRIPTION OF THE PREFERRED EMBODIMENTS

The base grease as the principal component in the inventive grease composition can be any one of conventional base greases composed of a lubricating base oil and a metal soap, optionally, with admixture of an antioxidant, rust preventive and other additives according to need without particular limitations. The lubricating base oil in turn is also not particularly limited and suitable oils include paraffinic and naphthenic mineral oils and diesters, α-olefins and the like synthetic oils. Suitable metal soaps as the thickener include those formed of a fatty acid such as stearic acid, 12-hydroxystearic acid and the like and an alkali or alkaline earth metal such as lithium, sodium, potassium, magnesium and calcium and aluminum or, in particular, an alkali metal hydroxide. The antioxidant may be α-naphthylamine and the rust preventive may be barium sulfonate.

Preferable base greases, in particular, are lithium soap-based greases, calcium soap-based greases, and lithium-calcium soap-based greases.

As is mentioned above, the grease composition of the invention comprises 100 parts by weight of the base grease as described above admixed with (a) from 1 to 4 parts by weight of a zinc dithiophosphate, (b) from 2 to 6 parts by weight of a phosphoric acid ester and (c) from 0.5 to 2 parts by weight of an organotin compound.

The zinc dithiophosphate as the component (a) added to the base grease in the inventive grease composition is a compound represented by the following general formula $$(RO)_2\overset{\overset{\displaystyle S}{\|}}{P}-S-Zn-S-\overset{\overset{\displaystyle S}{\|}}{P}(OR)_2, \qquad (1)$$

in which each of the four R groups is an alkyl or an aryl group independently from the other. The alkyl group as the group denoted by R preferably has from 3 to 12 carbon atoms though not limited thereto and the aryl group as the group R is also not particularly limitative including those substituted aryl groups, the substituent group being preferably an alkyl group.

Particularly preferable examples of the zinc dithiophosphate represented by the general formula (1) above are those in which the groups R are mainly sec-hexyl groups, mainly secalkyl groups having 5 or less of carbon atoms, combination of isobutyl groups and n-amyl groups, mainly isoamyl groups and mainly alkylaryl groups. More particularly, preferable zinc dithiophosphates include zinc dioctyldithiophosphate, zinc diisoamyldithiophosphate, zinc dihexyldithiophosphate, zinc diisobutyldithiophosphate and the like, of which zinc dioctyldithiophosphate is the most preferable.

The zinc dithiophosphate represented by the above given general formula (1) can readily be prepared by the reaction of zinc oxide with a dithiophosphate ester which is a reaction product of an alcoholic or phenolic compound with phosphorus pentasulfide.

The amount of the above described zinc dithiophosphate added to the inventive grease composition is usually in the range from 1 to 4 parts by weight or, preferably, from 2 to 3 parts by weight per 100 parts by weight of the base grease.

Various phosphoric acid esters are suitable as the component (b) added to the base grease in the inventive grease composition without particular limitations including, for example, tributyl phosphate, trioleyl phosphate, tricresyl phosphate, trimethyl phosphate, triethyl phosphate, triphenyl phosphate and the like, of which tricresyl phosphate, tributyl phosphate and trioleyl phosphate are preferred.

The amount of the above described phosphoric acid ester added to the inventive grease composition is usually in the range from 2 to 6 parts by weight or, preferably, from 3 to 4 parts by weight per 100 parts by weight of the base grease.

The third essential additive, i.e. component (c), in the inventive grease composition is an organotin compound which can be one of those described, for example, in Japanese Patent Kokai Nos. 55-165997 and 57-3894 and Japanese Patent Publication No. 53-7441. Several examples of the suitable organotin compound include monomethyltin tris(butyl mercaptide), monomethyltin tris(-thioglycolic acid octoate), dimethyltin bis(β-mercaptopropionic acid octoate), monobutyltin tris(octyl mercaptide), dibutyltin bis(thioglycolic acid octoate), dibutyltin bis(thioglycolid acid oleate), dibutyltin bis(β-mercaptopropionic acid cyclohexoate), dihexyltin bis(octyl thioglycolate), monooctyltin tris(thioglycolic acid isooctoate), monooctyltin tris(thioglycolic acid methoxybutyrate), dioctyltin bis(laurylmercaptide), dioctyltin bis(octyl thioglycolate), dioctyltin bis(thioglycolic acid isooctoate), dioctyltin bis(thioglycolic acid methoxybutyrate), dioctyltin bis(β-mercaptopropionic acid octoate), dioctyltin bis(β-mercaptopropionic acid methoxybutyrate), dioctyltin bis(methoxybutyl thiopropionate), trioctyltin mono(thioglycolic acid hexoate), dilauryltin bis(laurylmercaptide), dilauryltin bis(thioglycolic acid benzoate) and the like, of which dihexyltin bis(octyl thioglycolate), dioctyltin bis(octyl thioglycolate) and dioctyltin bis(methoxybutyl thiopropionate) are preferred.

The amount of the above described organotin compound added to the inventive grease composition is usually in range from 0.5 to 2 parts by weight or, preferably, from 0.7 to 1.5 parts by weight per 100 parts by weight of the base grease.

In addition to the above described requirements for the amounts of addition of the individual components (a), (b) and (c) per 100 parts by weight of the base grease, a more preferable formulation of the inventive grease composition should satisfy the conditions that the total amount of the components (a) and (b) is at least 4 parts by weight per 100 parts by weight of the base grease and the weight ratio of the component (c) to the component (a) is at least $\frac{1}{4}$. When the components (a), (b) and (c) are added to the base grease in such a proportion that the above mentioned conditions are satisfied, the inventive grease composition is imparted with further improved properties as a result of the synergism of the components.

In the preparation of the inventive grease composition by the admixture of the components (a), (b) and (c) to the base grease, it is preferable that the addition of these components follows the saponification, dehydration and gelation with the lubricating base oil and the metal soap as the starting materials of the base grease.

The grease composition of the present invention is excellent in the lubricant performance and free from the problem of the formation of a black denaturated matter even after prolonged use. Furthermore, the inventive grease composition is prepared without the addition of any solid ingredient such as molybdenum sulfide so that needle bearings and the like lubricated parts are free from the danger that the smooth rotation thereof is disturbed by the solid matter entering the needles of the needle bearing. Therefore, the inventive grease composition is usable in any machine part including a constant velocity joint regardless of the type thereof which may be of the triport type or the bar field type so that great advantages are obtained by using the inventive grease composition.

In addition, an additional advantage is obtained in the preparation of the inventive grease composition because the inventive grease composition is prepared without any solid ingredient such as molybdenum sulfide so that all of the components can readily and uniformly be blended together to easily give the product of the grease composition.

Accordingly, the inventive grease composition can be utilized in all varieties of the fields including industrial machines, traffic vehicles and others.

In the following, the grease composition of the present invention is described in more detail by way of examples together with some comparative examples.

EXAMPLES 1 to 13 and Comparative Examples 1 to 8

A base grease was prepared from 8.5% by weight of a lithium soap of 12-hydroxystearic acid, 90.5 % by weight of a lubricating base oil which was a paraffinic #500 neutral oil having a viscosity of about 92 centistokes at 40° C. and 1% by weight of 2,6-di-tert-butyl 4-methylphenol as an antioxidant. Grease compositions were prepared each by admixing 100 parts by weight of the above prepared base grease with a zinc dithiophosphate as the component (a), a phosphoric acid ester as the component (b) and an organotin compound as the component (c) according to the formulation indicated in Table 1 for Examples 1 to 13 and in Table 2 for Comparative Examples 1 to 8.

Each of the thus prepared grease compositions was subjected to the Timken wear test according to the procedure specified in ASTM D 2782 after 8 hours of working under a load of 10 lbs. and the Falex test according to the procedure specified in ASTM D 2670 after 2 hours of working under a load of 400 lbs. to give the results shown in the tables. All of the grease compositions in Examples 1 to 13 passed the Timken wear test and no discoloration was found in each of the compositions. No discoloration was found also in each of the grease compositions prepared in Examples 1 to 13 after the Timken wear test.

Further, the grease compositions prepared in Examples 2 and 4 and Comparative Example 3 were subjected to a durability test in an actual triport-type constant velocity joint. The testing conditions and the results obtained in the test are as shown below.

The test was undertaken in a triport-type constant velocity joint for actual vehicle with a mounting angle of 10° operated under a torque of 20 kg-m and velocity of revolution of 400 r.p.m. for 100 hours and the joint was disassembled to examine the condition of inside wear and the grease composition. The results were that almost no wear was found on the joint when the grease composition of Example 2 or 4 was used for lubrication and no black denaturated matter was found in the grease while a black denaturated matter was found in the grease composition of Comparative Example 3 although the wear of the joint was not much larger than with the grease compositions of Examples 2 and 4.

TABLE 1

| | | | Example No. | | | | | | | | | | | | |
|---|---|---|---|---|---|---|---|---|---|---|---|---|---|---|---|
| | | | 1 | 2 | 3 | 4 | 5 | 6 | 7 | 8 | 9 | 10 | 11 | 12 | 13 |
| Formula- | Compo- | Zinc dioctyldithio- | 1.0 | 1.0 | 2.0 | 3.0 | 4.0 | 3.0 | 1.0 | 2.0 | 1.0 | 4.0 | — | — | 2.0 |

TABLE 1-continued

| | | | Example No. | | | | | | | | | | | | |
|---|---|---|---|---|---|---|---|---|---|---|---|---|---|---|---|
| | | | 1 | 2 | 3 | 4 | 5 | 6 | 7 | 8 | 9 | 10 | 11 | 12 | 13 |
| tion, parts by weight | nent | phosphate | | | | | | | | | | | | | |
| | (a) | Zinc diisoamyldi-thiophosphate | — | — | — | — | — | — | — | — | — | — | 2.0 | 3.0 | — |
| | Compo-nent (b) | Tricresyl phosphate | 3.5 | 5.0 | 3.0 | 3.0 | 2.0 | 3.0 | 3.0 | 3.0 | 2.0 | 2.0 | — | — | 3.0 |
| | | Tributyl phosphate | — | — | — | — | — | — | — | — | — | — | 3.0 | — | — |
| | | Trioleyl phosphate | — | — | — | — | — | — | — | — | — | — | — | 3.0 | — |
| | Compo-nent (c) | Dioctyltin bis(octyl thioglycolate) | 1.0 | 1.0 | 1.0 | 1.0 | 1.0 | 1.5 | 2.0 | 0.7 | 1.0 | 0.7 | 1.0 | — | — |
| | | Dioctyltin bis(methoxy-butyl thiopropionate) | — | — | — | — | — | — | — | — | — | — | — | — | 1.0 |
| | | Dihexyltin bis(octyl thioglycolate) | — | — | — | — | — | — | — | — | — | — | — | 1.0 | — |
| Results of test | Timken wear test | Evaluation | To pass test | To pass test | To pass test | To pass test | To pass test | To pass test | To pass test | To pass test | To pass test | To pass test | To pass test | To pass test | To pass test |
| | | Discoloration | No | No | No | No | No | No | No | No | No | No | No | No | No |
| | Falex test | Maximum temperature of oil, °C. | 145 | 140 | 145 | 140 | 140 | 140 | 145 | 145 | 140 | 138 | 140 | 145 | 145 |
| | | Amount of wear, mg | 10 | 6 | 4 | 3 | 3 | 2 | 2 | 3 | 14 | 10 | 14 | 12 | 8 |
| | | Discoloration | No | No | No | No | No | No | No | No | No | No | No | No | No |

TABLE 2

| | | | Comparative Example No. | | | | | | | |
|---|---|---|---|---|---|---|---|---|---|---|
| | | | 1 | 2 | 3 | 4 | 5 | 6 | 7 | 8 |
| Formula-tion, parts by weight | Compo-nent (a) | Zinc dioctyldithio-phosphate | — | 2.0 | 2.0 | 5.0 | — | — | — | — |
| | | Zinc diisoamyldi-thiophosphate | — | — | — | — | 0.5 | 2.0 | 2.0 | 2.0 |
| | Compo-nent (b) | Tricresyl phosphate | 5.0 | 1.0 | 3.0 | 3.0 | 5.0 | — | — | — |
| | | Tributyl phosphate | — | — | — | — | — | 8.0 | — | — |
| | | Trioleyl phosphate | — | — | — | — | — | — | 2.0 | 2.0 |
| | Compo-nent (c) | Dioctyltin bis(octyl thioglycolate) | 1.0 | 1.0 | — | 1.0 | — | — | 0.3 | 3.0 |
| | | Dioctyltin bis(methoxy-butyl thiopropionate) | — | — | — | — | — | — | — | — |
| | | Dihexyltin bis(octyl thioglycolate) | — | — | — | — | 1.0 | 1.0 | — | — |
| Results of test | Timken wear test | Evaluation | Seizure | Seizure | To pass test | To pass test | Seizure | To pass test | Seizure | To pass test |
| | | Discoloration | No | No | Black-ened | Black-ened | No | Slight | No | Slight |
| | Falex test | Maximum temperature of oil, °C. | 150 | 170 | 150 | 160 | 150 | 150 | 160 | 160 |
| | | Amount of wear, mg | 10 | 30 | 10 | 20 | 10 | 10 | 15 | 10 |
| | | Discoloration | No | Black-ened | Black-ened | Black-ened | Black-ened | Slight | Black-ened | Slight |

What is claimed is:

1. A grease composition which comprises:

(a) from 1 to 4 parts by weight of a zinc dithiophosphate;

(b) from 2 to 6 parts by weight of a phosphoric acid ester; and (c) from 0.5 to 2 parts by weight of an organotin compound admixed in 100 parts by weight of a base grease.

2. The grease composition as claimed in claim 1 wherein the zinc dithiophosphate is a compound represented by the general formula $$(RO)_2\overset{\overset{\displaystyle S}{\|}}{P}-S-Zn-S-\overset{\overset{\displaystyle S}{\|}}{P}(OR)_2,$$

in which each of the groups denoted by the symbol R is an alkyl or an aryl group independently from the other.

3. The grease composition as claimed in claim 2 wherein the zinc dithiophosphate is a compound selected from the class consisting of zinc dioctyldithiophosphate, zinc diisoamyldithiophosphate, zinc dihexyldithiophosphate and zinc diisobutylphosphate.

4. The grease composition as claimed in claim 1 wherein the phosphoric acid ester is selected from the class consisting of tricresyl phosphate, tributyl phosphate and trioleyl phosphate.

5. The grease composition as claimed in claim 1 wherein the organotin compound is selected from the class consisting of dihexyltin bis(octyl thioglycolate), dioctyltin bis(octyl thioglycolate) and dioctyltin bis(methoxybutyl thiopropionate).

6. The grease composition as claimed in claim 1 wherein the total amount of the components (a) and (b) is at least 4 parts by weight per 100 parts by weight of the base grease and the weight ratio of the component (c) to the component (a) is at least one fourth.

7. The grease composition as claimed in claim 1 wherein the amount of the component (a) is in the range from 2 to 3 parts by weight per 100 parts by weight of the base grease.

8. The grease composition as claimed in claim 1 wherein the amount of the component (b) is in the range from 3 to 4 parts by weight per 100 parts by weight of the base grease.

9. The grease composition as claimed in claim 1 wherein the amount of the component (c) is in the range from 0.7 to 1.5 parts by weight per 100 parts by weight of the base grease.

10. The grease composition as claimed in claim 2 wherein the phosphoric acid ester is selected from the class consisting of tricresyl phosphate, tributyl phosphate and trioleyl phosphate; and wherein the organotin compound is selected from the class consisting of dihexyltin bis(octyl thioglycolate), dioctyltin bis-(octyl thioglycolate) and dioctyltin bis(methoxybutyl thiopropionate).

11. The grease composition as claimed in claim 10 wherein in said zinc dithiophosphate, R is a $C_3$–$C_{12}$ alkyl; the amount of the component (a) is in the range from 2 to 3 parts by weight per 100 parts by weight of the base grease; the amount of the component (b) is in the range from 3 to 4 parts by weight per 100 parts by weight of the base grease; and the amount of the component (c) is in the range from 0.7 to 1.5 parts by weight per 100 parts by weight of the base grease.

12. The grease composition as claimed in claim 11 wherein the zinc dithiophosphate is a compound selected from the class consisting of zinc dioctyldithiophosphate, zinc diisoamyldithiophosphate, zinc dihexyldithiophosphate and zinc diisobutylphosphate; and the total amount of the components (a) and (b) is at least 4 parts by weight per 100 parts by weight of the base grease and the weight ratio of the component (c) to the component (a) is at least one fourth.

13. A grease composition which comprises:

(a) from 1 to 4 parts by weight of a zinc dithiophosphate;

(b) from 2 to 6 parts by weight of a phosphoric acid ester selected from the group consisting of tributyl phosphate, trioleyl phosphate, tricresyl phosphate, trimethyl phosphate, triethyl phosphate and triphenyl phosphate; and (c) from 0.5 to 2 parts by weight of a di($C_l$–$C_{12}$)-tetravalent organotin compound.

14. The grease composition as claimed in claim 13 wherein in said zinc dithiophosphate, R is a $C_3$–$C_{12}$ alkyl).

15. The grease composition as claimed in claim 14 wherein the amount of the component (a) is in the range from 2 to 3 parts by weight per 100 parts by weight of the base grease; the amount of the component (b) is in the range from 3 to 4 parts by weight per 100 parts by weight of the base grease; the amount of the component (c) is in the range from 0.7 to 1.5 parts by weight per 100 parts by weight of the base grease; and the total amount of the components (a) and (b) is at least 4 parts by weight per 100 parts by weight of the base grease and the weight ratio of the component (c) to the component (a) is at least one fourth.

16. The grease composition of claim 15 wherein the zinc dithiophosphate is a compound selected from the class consisting of zinc dioctyldithiophosphate, zinc diisoamyldithiophosphate, zinc dihexyldithiophosphate and zinc diisobutylphosphate; the phosphoric acid ester is selected from the class consisting of tricresyl phosphate, tributyl phosphate and trioleyl phosphate; and the organotin compound is selected from the class consisting of dihexyltin bis(octl thioglycolate), dioctyltin bis-(octyl thioglycolate) and dioctyltin bis(methoxybutyl thiopropionate).

17. The grease composition of claim 15 wherein the zinc dithiophosphate is zinc dioctyldithiophosphate or zinc diisoamyldithiophosphate; the phosphoric ester is tricresyl phosphate, tributyl phosphate or trioleyl phosphate; and the organotin compound is dioctyltin bis(octyl thioglycolate), dioctyl bis(methoxybutyl thiopropionate) and dihexyltin bis(octyl thioglycolate).

* * * * *